United States Patent [19]

Kock et al.

[11] Patent Number: 4,498,395

[45] Date of Patent: Feb. 12, 1985

[54] POWDER COMPRISING COATED TUNGSTEN GRAINS

[75] Inventors: Wulf Kock; Rainer Schmidberger, both of Markdorf; Wolfgang Wagner, Weingarten, all of Fed. Rep. of Germany

[73] Assignee: Dornier System GmbH, Friedrichshafen, Fed. Rep. of Germany

[21] Appl. No.: 511,510

[22] Filed: Jul. 6, 1983

[30] Foreign Application Priority Data

Jul. 16, 1983 [DE] Fed. Rep. of Germany ..... 3226648

[51] Int. Cl.[3] ..... F42B 11/00; C22C 1/02

[52] U.S. Cl. ..... 102/517; 102/501; 419/35; 427/213; 427/437; 427/438; 428/570

[58] Field of Search ..... 29/1.2; 102/501, 517; 419/35, 36; 427/437, 438, 213; 428/570

[56] References Cited

U.S. PATENT DOCUMENTS

| | | | |
|---|---|---|---|
| 3,949,677 | 4/1976 | Voss | 102/501 |
| 4,050,933 | 9/1977 | Sanderow et al. | 419/35 X |
| 4,060,414 | 11/1977 | Kaufman | 419/35 X |
| 4,440,800 | 4/1984 | Morton et al. | 427/220 X |

*Primary Examiner*—Leland A. Sebastian

*Attorney, Agent, or Firm*—Hammond & Littell, Weissenberger & Dippert

[57] ABSTRACT

A heterogenous powder comprising particles of tungsten grains with a diameter of less than 1 μm with a binder sponge-like coating of at least one metal selected from the group consisting of nickel, copper, silver, iron, cobalt, molybdenum and rhenium with a particle diameter of 10 to 50 μm, a process for the preparation thereof, method of forming sintered elements therefrom and the elements produced thereby being useful as penetrating projectiles.

27 Claims, 4 Drawing Figures

POWDER COMPRISING COATED TUNGSTEN GRAINS

STATE OF THE ART

Highly stressed metal parts, particularly penetrating impact projectiles, require materials of high density and in addition to the precious metals gold and platinum, uranium and tungsten meet these high-density requirements. The only high-density metal that is traded at a reasonable price is tungsten, but as a pure metal, tungsten is difficult to process since it is very brittle. It is less suitable as an impact projectile since it does not withstand the occurring tensile-and compressive stresses. Impact projectiles are solid cylinders of metal whose length far exceeds the caliber and when an impact projectile hits an inclined armor plate, the projectile tilts. Bending moments occur in the relatively long body which frequently lead to breakage of the projectile and thus to relative ineffectiveness.

For this reason, only compound materials are suitable for use as a construction material for such highly stressed parts which contain tungsten embedded in a ductile binder alloy. To obtain great strength and ductility at high density, a structure is required which contains tungsten in the form of fine individual particles which are surrounded on all sides by a very thin layer of a ductible material. The texture must not show any pores and the mechanical properties such as tensile stress and breaking elongation of the parts are more advantageous, the finer the texture is.

Eisenkolb ["Fortschritte der Pulvermetallurgie" 1963, Vol. II, page 439] describes adding tungsten-soluble elements such as rhenium to increase the ductility of tungsten and page 430 to 433 indicates properties of homogeneous tungsten alloys and the possibility of solid phase-sintering for homogeneous tungsten alloys. Homogeneous tungsten alloys are not suitable for the production of penetrating projectiles because of their low ductility.

Also known is the production of parts from heterogeneous tungsten alloys by liquid phase-sintering by compressing a mixture of tungsten powder and powdered alloying components and subsequently sintering it. To obtain a pore-free texture, the technique of liquid phase-sintering is used and the sintering temperature is selected so high that the binder alloy is fusible whereby three processes take place namely: 1. The binder alloy is formed from the powders of individual alloying components. 2. The fusible binder alloy envelops the tungsten grains and 3. The body is compressed until it is completely free of pores. In the sintered state, the tungsten grains are always larger than the powder particles in the original powder and the appearance of a fusible phase in the sintering process always results in an additional increase of the tungsten grains which is made possible by dissolving and recrystallizing processes between tungsten and liquid matrix. The phenomenon of the grain increase of solid deposits in contact with liquids is of a principal nature and is known under the term "Ostwald ripening".

Liquid phase-sintered tungsten alloys have typically a structure of spherical tungsten particles which are present in a spectrum of particles of about 10–60 μm which are embedded in a binder alloy. The strength and breaking elongation, however, are limited by the largest existing particles, here ab. 60 μm and frequently, it can be observed that large grains have coalesced. Materials with such a coarse-grained structure have insufficient strength and only a low deformability. Even by selecting finer starting powders, no substantially finer textures can be obtained since the driving forces responsible for the Ostwald ripening (reduction of the free surface energy) rise with increasing specific surface of the particles. Nor can a substantial refinement of the texture be obtained with the present state of the art by isostatic hot-pressing since it also requires a liquid phase to permit the formation of the binder alloy metals and a pore-free enclosure of the tungsten grains by the binder alloy.

OBJECTS OF THE INVENTION

It is an object of the invention to provide a novel heterogeneous fine alloying powder of tungsten with sponge-like binder outer coating of at least one metal and a process for the preparation thereof.

It is another object of the invention to provide novel sintered elements with a high specific gravity, a tensile strength of at least 1200 N/mm$^2$ and a breaking elongation of at least 25% and a method of sintering.

It is an additional object of the invention to provide improved penetrating projectiles.

These and other objects and advantages of the invention will become obvious from the following detailed description.

THE INVENTION

The novel alloying heterogeneous powder of the invention comprises particles of tungsten grains with a diameter of less than 1 μm with a binder sponge-like coating of at least one metal selected from the group consisting of nickel, copper, silver, iron, cobalt, molybdenum and rhenium with a particle diameter of 10 to 50 μm. The said particles are excellent for forming objects by sintering which have the following properties without any thermomechanical after treatments.

The sintered bodies of the invention have a tensile strength greater than 1200 N/nm$^2$ and a simultaneous breaking elongation greater than 25% while the prior sintered elements had tensile strengths of 1200 N/nm$^2$ but only breaking elongation of 8 to 10% or breaking elongation of 25% but tensile strengths of only 900 N/nm$^2$. This simultaneous presence of extreme tensile strengths with extreme breaking elongation was not previously known so that sintered tungsten parts must be considered ideal materials for impact projectiles. Both the high compressive and tensile stresses during acceleration in the barrel and the high bending moments and pressures in the projectile when hitting an armor are withstood by the material without being damaged. The excellent properites also permit the sintered parts of the invention to be used for other functions in science and technology where the greatest demands are made on strength and ductility including electrical contacts.

Referring now to the drawings.

Figure 1:
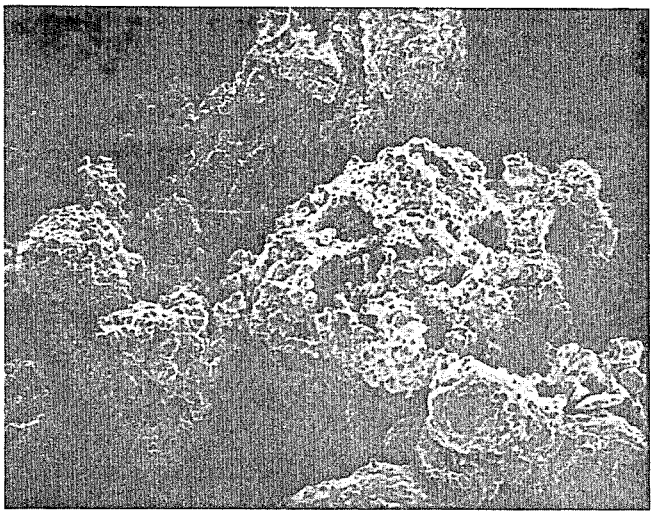
FIG. 1 is a photomicrograph of powdered particles of the invention magnified 1000 times.

It can be seen from FIG. 1 that the powder of the invention is comprised of particles in substantially spherical form on the right of the photo with a diameter of 10 to 50 μm and a sponge-like outer structure. The sponge structure is formed with tungsten grains with a diameter of about 1 μm covered and held together by a coating of the binder metal which determines the distribution of tungsten and binder materials characteristic of the sintered element.

Unlike the powder mixtures of tungsten, iron, nickel and cobalt of the prior art, the powder of the invention is finished alloyed with the tungsten grains being already covered with a binder alloy of iron, nickel and cobalt, for instance. In the production of dense sintered bodies with the powder of the invention, the formation of a binder alloy and coating of the tungsten grains does not have to be effected with a fusible stage and the powder can be sintered directly to a dense body in the solid phase.

The sponge structure of the powder particles is loose so that the powder can be compressed with a pressure of 3 kbar to about 50% of the theoretical density of a compact and this high green density and the large specific surface on the order of 1 $m^2/g$ allows pressure-free dense sintering of the compact without a liquid phase. After compacting by compression, the mixture is sintered in the solid phase, preferably in the presence of hydrogen. At a sintering temperature of 900° C., the sintering density already attains over 95% of the theoretical density and with sintering temperatures between 1200° and 1300° C., it is possible to obtain pore-free sintered bodies.

Figure 2:
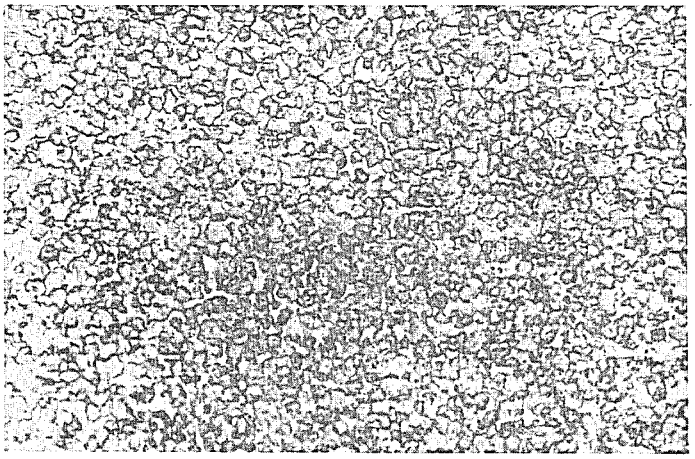
FIG. 2 is a photomicrograph of a sintered alloy of the invention magnified 600 times and FIG. 3 is photomicrograph of a prior art liquid phase sintered alloy magnified 600 times.
Figure 3:
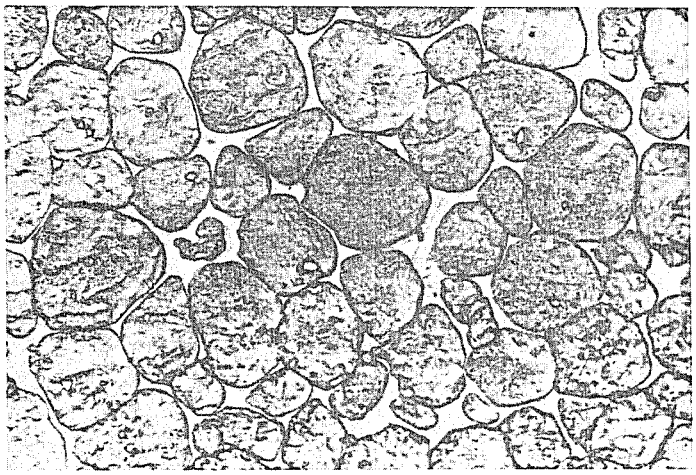

The structure of the solid phase-sintered compacts of FIG. 2, unlike the liquid phase-sintered parts of FIG. 3, shows no spherical tungsten grains, but a practically space-filled arrangement of polygonal tungsten grains between which the matrix metal is distributed in a thin layer. The sintered structure of FIG. 2 is substantially more fine-grained than the structure of FIG. 3 obtained by liquid phase-sintering. As can be seen from FIG. 2, the diameter of the tungsten grains is 2–5 μm and the grain sizes are distributed in a narrow range. When directed forces are applied, a linear structure can be obtained (not shown) where the tungsten grains are deformed over 200%. The fine-grained and homogeneous structure is the reason for the superior mechanical properties of the sintered parts produced from the powders according to the invention.

Figure 4:
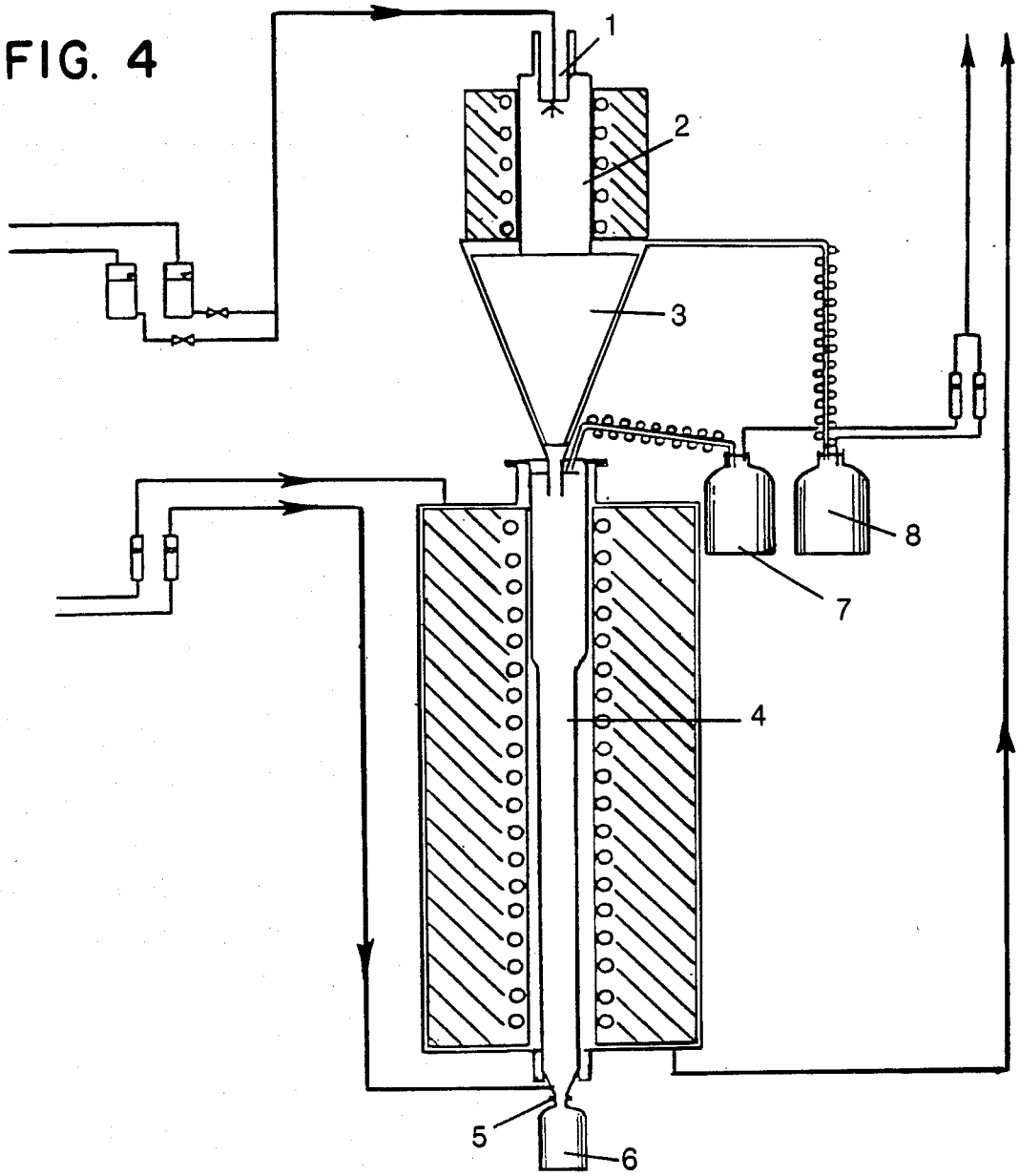
FIG. 4 is a schematic outline of an apparatus for producing the alloy powder of the invention.

FIG. 4 illustrates an apparatus for the production of the tungsten powder of the invention comprising spray nozzle 1, evaporator element 2, separator 3, reducing element 4, hydrogen inlet 5 and discharge element 6 as well as two reservoirs 7 and 8 for condensate and waste gas.

The novel process of the invention for the preparation of the heterogeneous powder comprises forming a solution of a tungsten salt and the matrix metal salts, forming a spray of the said solution with a mean droplet diameter of less than 50 μm at elevated temperatures and a reduced pressure to form sponge-like mixed metal oxide particles with a mean diameter of about 10 to 50 μm, separating the gaseous evaporation products and reducing the particles free falling in an upwardly passing hydrogen current at 950° to 1200° C. to obtain the sponge-like metal powder with a mean diameter of 10 to 50 μm.

Perferably, the solution of tungsten and metal salts is sprayed by sprayer 1 into evaporator 2 at about 800° C. wherein fine particles of the homogeneous metal salts or compounds of the alloying components distributed in each other are formed and the solid and gaseous evaporation products are separated at about 400° C. in separator 3 with the condensates and the gaseous products being collected in reservoirs 7 and 8, respectively. The solid particles which are mainly oxides fall freely through reducing apparatus 4 while passing a slowly rising hydrogen current upward therethrough at 950° C. to 1200° C. to reduce the oxide particles to free metal. The velocity of the hydrogen current is regulated by hydrogen inlet 5 and the reduced particles are collected through discharge 6. The production of the intermediate salts or oxides and their reduction can also be performed successively in two separate apparatuses.

The fineness of the spray, the concentration and composition of the solution and the gentle reduction of the salt or oxide particles without coalescence of the salt or metal particles determine the excellent sintering of the powder which permits the solid phase sintering. An atomization of a solution which produces a mean droplet spectrum of 30 to 50 μm is sufficient for a solution with a salt concentration of 600 g of dissolved metals per liter and the solid particles have a particle size distribution comparable to the droplet spectrum. The sponge-like structure of the particles obtained at this point is important for obtaining short diffusion paths and short reaction times in the reducing step whereby the particles can be reduced by free falling into the counter current hydrogen stream which prevents coalescence of the particles.

The solution of tungsten and other metals is effected by preparing separate solutions of tungsten and the other metals and mixing the same just before use. Water has been found to be an excellent solvent which results in oxide mixtures of solid particles but other solvents may be used such as ammonium hydroxide.

Examples of suitable soluble tungsten are ammonium metatungstenate or alkaline solutions of tungstic oxide and the additional metals may be in any soluble salt form such as nitrate, chloride, acetate, etc. To avoid premature precipitation of the metals, a sequestering agent such as ethylene-diaminetetracetic acid salts is added to the solutions.

The solution may be prepared either by working in a weakly acid medium at a pH $>3$ using ammonium-metatungstenate as the soluble tungsten compound or by preparing an ammoniacal solution of tungstic acid or its anhydride or one of its salts and prevents the precipitation of the cations of the matrix metals by sequestration either with ammonia or with the usual organic sequestrants such as EDTA. The use of colloidal tungsten compounds, e.g. in the form of $H_2WO_4$ag. $WO_3$ or ammonium paratungstenate leads after a short time to disturbances in the atomization of the solution. In the case of ferrous solutions, salts of bivalent iron sequestered with ammonia are used and the exposure to air must be carefully avoided since trivalent iron also interferes with the use of ammonium-metatungstenate by adjusting the pH-value of the solution to about 1 in the usual concentrations whereby after storage for about 1 hour, a precipitate is obtained which prevents atomization of the solution. Solutions which contain ferrous ions only remain clear at room temperature for more than 24 hours after filtration over blueribbon filters.

The preferred particles of the invention for the preparation of penetration projectiles are tungsten grains with a binder coating of iron and nickel or nickel and copper and most preferably cobalt, iron and nickel in about a 1:1:3 ratio. The amount of binder metal may vary from 5 to 20%, preferably about 10% by weight of the particles. The preferred binder coatings for particles to be used for electrical contacts are copper and silver because of their good electrical conductivity.

The novel method of forming sintered elements comprises compressing the heterogeneous powders of the invention to form a compact of the desired shape with a high green density and sintering the compact at 600° to 1300° C. in a reducing atmosphere and degassing the sintered body whose structure is pore free and consists of polygonal tungsten grains with a mean diameter less than 5 μm which substantially occupy all the space therein with a thin layer of binder between them.

In the following examples there are described several preferred embodiments to illustrate the invention. However, it is to be understood that the invention is not intended to be limited to the specific embodiments.

EXAMPLE 1

A refluxing suspension of 117.3 g of $WO_3$ in 300 ml of water was stirred in an 800 ml beaker for three hours during which the color of the sediment turned from yellow to white and after cooling the mixture to room temperature, 100 ml of 33% ammonium hydroxide solution were added thereto. The mixture was slightly heated for 30 to 40 minutes and the resulting practically clear solution was filtered through a folded filter to form the tungsten containing solution.

A mixture of 24.3 g of $Ni(NO_3)_2.6H_2O$, 6.0 g of $Co(CH_3COO)_2.4H_2O$, 5.06 g of $Fe(NO_3)_3.9H_2O$, 45 g of ethylenediaminetetra acetic acid and 80 ml of water was stirred while adding dropwise 30 to 40 ml of 33% ammonium hydroxide solution to obtain a dark-violet solution which was combined with the tungsten solution.

Using the apparatus of FIG. 4, two liters of the combined solution were added per hour through spray nozzle 1 and 400 standard liters per hour of hydrogen were added through inlet 5 to obtain an >80% yield of sponge-like, spherical particles with an average diameter of 20–30 μm. The particles consisted of 90% by weight of a tungsten core with a coating of 6% by weight of nickel, 2% by weight of iron and 2% by weight of cobalt and contained less than 20 ppm $SiO_2$, 500 ppm of nitrogen and 0 to 900 ppm of carbon.

EXAMPLE 2

Using the procedure of Example 1, a solution of 113.5 g of $WO_3$ is an ammonium hydroxide solution was prepared and 450 ml of the filtered solution were placed into a dropping funnel leading into a 3-necked flask equipped with a second dropping funnel, a gas inlet tube and a gas outlet connected to a washing bottle and a suction tube. A mixture of 39.6 g of $Ni(NO_3)_2.6H_2O$, 3.6 g of $FeCl_2.4H_2O$ and 2.2 g of $CoCl_2$ were placed in the flask and 100 ml of 50% ammonium hydroxide solution were placed in the second dropping funnel. The 3-necked flask and the gas space above the solutions in the dropping funnels were flushed with nitrogen and the ammonium hydroxide solution was added dropwise with stirring to the flask. Then, the tungsten containing solution was added thereto dropwise with stirring and the resulting solution in the absence of air was treated in the apparatus of FIG. 4 to produce the sponge-like, spherical particles of the invention with a particle diameter of 20–30 μm.

EXAMPLE 3

Using the procedure of Example 1, 126 g of $WO_3$ were dissolved in sufficient ammonium hydroxide solution to obtain after filtration 900 ml of a tungsten containing solution. A mixture of 393 g of $CuSO_4.5H_2O$ and 500 ml of water was heated at 50° C. until dissolution was complete and then 500 ml of 33% ammonium hydroxide solution was added thereto to obtain a copper containing solution. The two solutions were combined and while avoiding prolonged standing in the cold were treated as in Example 1 to obtain sponge-like spherical particles of tungsten coated with a thin layer of copper.

EXAMPLE 4

485.3 g of ammonium metatungstenate were slowly added with vigorous stirring to 800 ml of water and stirring was continued until a clear tungsten containing solution was obtained. A solution of 28.5 g of $FeCl_2.4H_2O$ in 500 ml of water was slowly added to the mixture with vigorous stirring to obtain an iron-tungsten solution while avoiding the presence of ferric ions which will cause the formation of a yellowish white precipitate. A 500 ml solution of 118.9 g of $Ni(NO_3)_2 . 6H_2O$ and 39.5 g of $Co(NO_3)_2 . 6H_2O$ in water were added to the iron-tungsten solution and the combined solution was treated as in Example 1 to obtain the sponge-like particles.

EXAMPLE 5

The powder of Example 1 which had a bulk density of 0.85 g/cc was compressed by axial or isostatic cold pressing at a pressure of 3 kbar into test pieces with a green density of 8.5 g/cc. The sponge-like structure of the powder ensured a good interlocking of the particles after compression resulting in compacts with a high green strength without the addition of binders. The compacts were sintered in a dry hydrogen stream for 4 hours at 1300° C. and was then degassed for 30 minutes at 1050° C. at a vacuum of $10^{-2}$ mbar. The resulting sintered body was absolutely pore-free and had a fine-grained sintered structure with tungsten grains with a diameter of 2 to 5 μm surrounded by a thin film of the Ni-Co-Fe alloy useful for the production of impact projectiles.

Various modifications of the products and methods of the invention may be made without departing from the spirit or scope thereof and it should be understood that the invention is intended to be limited only as defined in the appended claims.

What we claim is:

1. A heterogeneous powder comprising particles of tungsten grains with a diameter of less than 1 μm with a binder sponge-like coating of at least one metal selected from the group consisting of nickel, copper, silver, iron, cobalt, molybdenum and rhenium with a particle diameter of 10 to 50 μm.

2. A powder of claim 1 wherein the tungsten is about 80 to 95% by weight of the particles.

3. A powder of claim 1 wherein the tungsten is about 90% by weight of the particles.

4. A powder of claim 1 wherein the binder coating is made of iron and nickel.

5. A powder of claim 1 wherein the binder coating is made of nickel and copper.

6. A powder of claim 1 wherein the binder coating is made of nickel, cobalt and iron.

7. A powder of claim 1 wherein the binder coating is made of nickel, cobalt and iron in a weight ratio of about 3:1:1.

8. A powder of claim 1 wherein the binder coating is made of copper or silver.

9. A process for the preparation of a heterogeneous powder of claim 1 comprising forming a solution of a tungsten salt and the matrix metal salts, forming a spray of the said solution with a mean droplet diameter of less than 50 μm at elevated temperatures and a reducing atmosphere to form sponge-like mixed metal oxide particles with a mean diameter of about 10 to 50 μm, separating the gaseous evaporation products and reducing the particles free falling in an upwardly passing hydrogen current at 950° to 1200° C. to obtain the sponge-like metal powder with a mean diameter of 10 to 50 μm.

10. The process of claim 9 wherein the evaporation is effected at about 800° C.

11. The process of claim 9 wherein the particles and the gaseous evaporation products are separated at about 400° C.

12. The process of claim 9 wherein the reduction is effected at 950° to 1200° C.

13. The process of claim 9 wherein the reduction step is performed separately.

14. The process of claim 9 wherein an ammoniacal solution of tungstic acid or its anhydride or a salt thereof is admixed with a solution of a salt of the binder metal in the form of an ammine complex.

15. The process of claim 14 wherein the salt of the binder metal is complexed with ethylenediaminetetraacetic acid.

16. The process of claim 9 wherein the mean droplet spectrum is 30 to 50 μm.

17. The process of claim 9 wherein the tungsten salt is ammoniummetatungstenate-$(NH_4)_6$ $H_2$ $W_{12}$ $O_{40}$ . $XH_2O$- and if iron is used as a binder surpowent it is added as a salt of bevalent iron.

18. A method of forming sintered elements comprising compressing the heterogeneous powders of claim 1 to form a compact of the desired shape with a high green density and sintering the compact at 600° to 1300° C. in a reducing atmosphere and degassing the sintered body whose structure is pore free and consists of polygonal tungsten grains with a mean diameter less than 5 μm which substantially occupy all the space therein with a thin layer of binder between them.

19. The method of claim 18 wherein the tungsten is about 80 to 95% by weight of the particles.

20. The method of claim 18 wherein the tungsten is about 90% by weight of the particles.

21. The method of claim 18 wherein the binder coating is made of iron and nickel.

22. The method of claim 18 wherein the binder coating is made of nickel and copper.

23. The method of claim 18 wherein the binder coating is made of nickel, cobalt and iron.

24. The method of claim 18 wherein the binder coating is made nickel, cobalt and iron in a weight ratio of about 3:1:1.

25. A powder of claim 18 wherein the binder coating is made of copper or silver.

26. A penetration projectile made of the material produced by the process of claim 22.

27. The projectile of claim 26 wherein the weight ratio of nickel, cobalt and iron is about 3:1:1.

* * * * *